US009308717B2

(12) United States Patent
Pantchev

(10) Patent No.: US 9,308,717 B2
(45) Date of Patent: Apr. 12, 2016

(54) PRINTING ASSEMBLY

(71) Applicant: Bunting Magnetics Co., Newton, KS (US)

(72) Inventor: George Pantchev, Newton, KS (US)

(73) Assignee: Bunting Magnetics Co., Newton, KS (US)

( * ) Notice: Subject to any disclaimer, the term of this patent is extended or adjusted under 35 U.S.C. 154(b) by 0 days.

(21) Appl. No.: 14/857,093

(22) Filed: Sep. 17, 2015

(65) Prior Publication Data

US 2016/0001547 A1 Jan. 7, 2016

Related U.S. Application Data

(62) Division of application No. 13/945,726, filed on Jul. 18, 2013, now Pat. No. 9,162,439.

(51) Int. Cl.

| | |
|---|---|
| ***B41F 27/02*** | (2006.01) |
| ***B41F 27/14*** | (2006.01) |
| ***B41F 27/12*** | (2006.01) |
| *B41F 13/10* | (2006.01) |
| *B41F 27/10* | (2006.01) |
| *B41F 13/20* | (2006.01) |

(52) U.S. Cl.

CPC ..... *B41F 27/02* (2013.01); *B41F 27/12* (2013.01); *B41F 13/10* (2013.01); *B41F 13/20* (2013.01); *B41F 27/105* (2013.01); *B41F 27/14* (2013.01)

(58) Field of Classification Search

None

See application file for complete search history.

(56) References Cited

U.S. PATENT DOCUMENTS

| | | | | |
|---|---|---|---|---|
| 1,674,635 | A | 6/1928 | Burden | |
| 1,958,299 | A * | 5/1934 | Ericksson | B41N 1/20 101/375 |
| 2,987,994 | A | 6/1961 | Allison | |
| 3,590,452 | A * | 7/1971 | Macleod | B05C 1/0808 101/375 |
| 3,739,722 | A | 6/1973 | Zottoli | |
| 3,971,313 | A * | 7/1976 | Voegelin | B41F 15/38 101/127.1 |
| 4,381,961 | A | 5/1983 | van der Velden | |
| 4,503,769 | A | 3/1985 | Andersen | |
| 6,363,850 | B1 | 4/2002 | McEachern | |
| 6,615,722 | B2 * | 9/2003 | Alberstadt | B41F 13/08 101/217 |
| 6,874,415 | B2 * | 4/2005 | Hoffmann | B41F 13/22 101/217 |
| 7,328,656 | B2 | 2/2008 | Jeurink | |

OTHER PUBLICATIONS

U.S. Appl. No. 13/604,292, Pantchev.

* cited by examiner

*Primary Examiner* — Jill Culler

(74) *Attorney, Agent, or Firm* — Kenneth H. Jack; Davis & Jack, L.LC.

(57) ABSTRACT

A printing assembly incorporating a clamping annulus having axial and oppositely axial ends, the clamping annulus's axial and oppositely axial ends having outside diameters, the axial end's outside diameter having an excess dimension defining a guide sleeve receiving space; a tiered clamping sleeve received within the clamping annulus, the tiered clamping sleeve having chamfered axial and oppositely axial ends; axial and oppositely axial jaw faces fitted for sloped engagements with the tiered clamping sleeve's ends; axial and oppositely axial jaws operatively connected to the axial and oppositely axial jaw faces, the axial jaw including an oppositely axially extending guide sleeve; an axle extending through the tiered clamping sleeve; and a screw mounted to the axle, the screw being adapted for pressing the axial and oppositely axial jaw faces against the tiered clamping sleeve's ends, and for radially outwardly wedging the ends toward the clamping annulus's tiered circumferential end.

7 Claims, 7 Drawing Sheets

PRINTING ASSEMBLY

CLAIM OF PRIORITY FROM AND BENEFIT OF PREVIOUSLY FILED U.S. PATENT APPLICATION

This patent application constitutes a divisional application claiming priority from and the benefit of the filing date of U.S. patent application Ser. No. 13/945,726, entitled "Printing Assembly", and filed Jul. 18, 2013. The inventor and applicant of said prior application and the inventor and applicant herein are the same. The Specification and drawings of said prior application are substantially identical to that which follows and are submitted herewith. The instant divisional application is filed during the pendency of said prior application.

FIELD OF THE INVENTION

This invention relates to magnetic print rolls and print cylinder assemblies which include multiplicities of embedded magnets within their outer circumferential surfaces. More particularly, this invention relates to such rolls and cylinders which are adapted for attachment to and detachment from print roll receiving and driving axles.

BACKGROUND OF THE INVENTION

Magnetic print rolls or cylinders commonly include configurations of the walls of their interior axle receiving bores which facilitate attachments to and detachments from print roll receiving and driving axles. Such interior bore wall structures commonly inefficiently and in a mechanically cumbersome manner facilitate attachments of the cylinder to driving axles and detachments therefrom.

The instant inventive printing assembly solves or ameliorates such problems and deficiencies by specially configuring the cylinder's axle receiving bore wall for ease in installation upon and deinstallation from a cylinder driving axle and for ease and efficiency in rigidly locking the cylinder thereon, and for unlocking the cylinder therefrom.

BRIEF SUMMARY OF THE INVENTION

A first structural component of the instant inventive printing assembly comprises a clamping annulus which has a tiered circumferential end or tiered outer circumferential aspect. Such clamping annulus necessarily has axially and oppositely axial ends, each such end having an outside diameter. In a preferred embodiment, the outside diameter of the clamping annulus's axial end is greater than or exceeds the outside diameter of the clamping annulus's oppositely axial end. Such diameter differential advantageously results in stepping or tiering of the clamping annulus, and such dimensional difference advantageously forms and defines a guide sleeve receiving space within and as a part of the axial end of the clamping annulus.

A further structural component of the instant inventive printing assembly comprises a cylinder or roll which, like the assembly's clamping annulus, has axial and oppositely axial ends. The assembly's cylinder component preferably has a cylindrically configured circumferential outer surface, and the cylinder preferably has a bore which is defined by a tiered inner wall. Like the assembly's clamping annulus component, the cylinder's tiered inner wall preferably has axially and oppositely axial ends. In the preferred embodiment, the axial end of the cylinder's tiered inner wall circumferentially and radially outwardly overlies the clamping annuluses axial end, and such wall's oppositely axial end correspondingly circumferentially and radially outwardly overlies the clamping annuluses oppositely axial end.

A further structural component of the instant inventive print assembly comprises a plurality of magnet receiving recesses, each recess among the plurality of magnet receiving recesses preferably extending radially inwardly into the cylinder from the cylinder's outer circumferential surface. In a preferred embodiment, pluralities of permanent magnets and magnetic strengthen enhancing pole pieces are fixedly embedded within the magnet receiving recesses for secure attachment and holding of flexible ferro-magnetic print dies.

In use of the instant inventive print assembly, the guide sleeve receiving space which is formed and defined within the clamping annulus and which is radially outwardly bounded by the axial end of the cylinder's tiered inner wall allows for convenient and mechanically efficient operation therein of an annular wedge clamp. Within such guide sleeve receiving space, clamp jaws and sleeve configured wedges may be forcefully moved along and driven between the cylinder's bore wall and a drive axle which extends axially through the cylinder bore. Such wedge driving clamping action is advantageously facilitated by the instant invention's specially configured and tiered clamping annulus.

In a preferred embodiment of the instant inventive assembly, the clamping annulus is further specially configured to present an annular land or radial transition which effectively divides the clamping annulus's axial and oppositely axial ends. Closely fitted axial and oppositely axial compression sleeves are preferably fixedly mounted to the cylinder at axial and oppositely axial ends of the cylinder bore's tiered inner wall. Preferably, such compression sleeves are mounted thereon at axial and oppositely axial sides of a cross-sectional plane which substantially bisects the cylinder's axial dimension.

Accordingly, objects of the instant invention include the provision of a printing assembly which incorporates components, as described above, and which arranges such components in relationship to each other in manners described above for the performance of and achievement of beneficial objects, as described above.

Other and further objects, benefits, and advantages of the present invention will become known to those skilled in the art upon review of the Detailed Description which follows, and upon review of the appended drawings.

DETAILED DESCRIPTION OF A PREFERRED EMBODIMENTS

Figure 1:
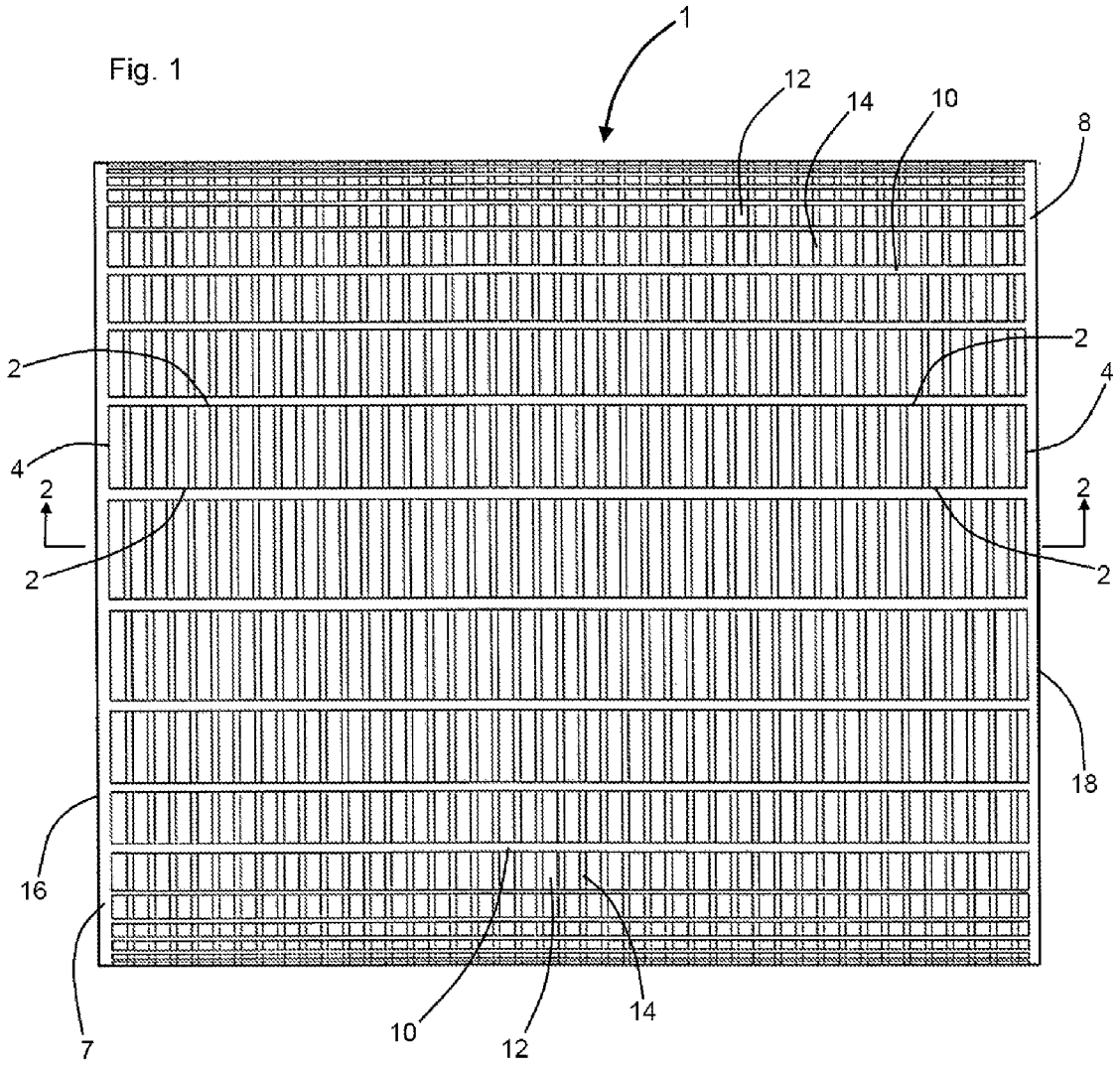
FIG. 1 is a side view of the outer circumferential surface of the instant inventive printing assembly.
Figure 2:
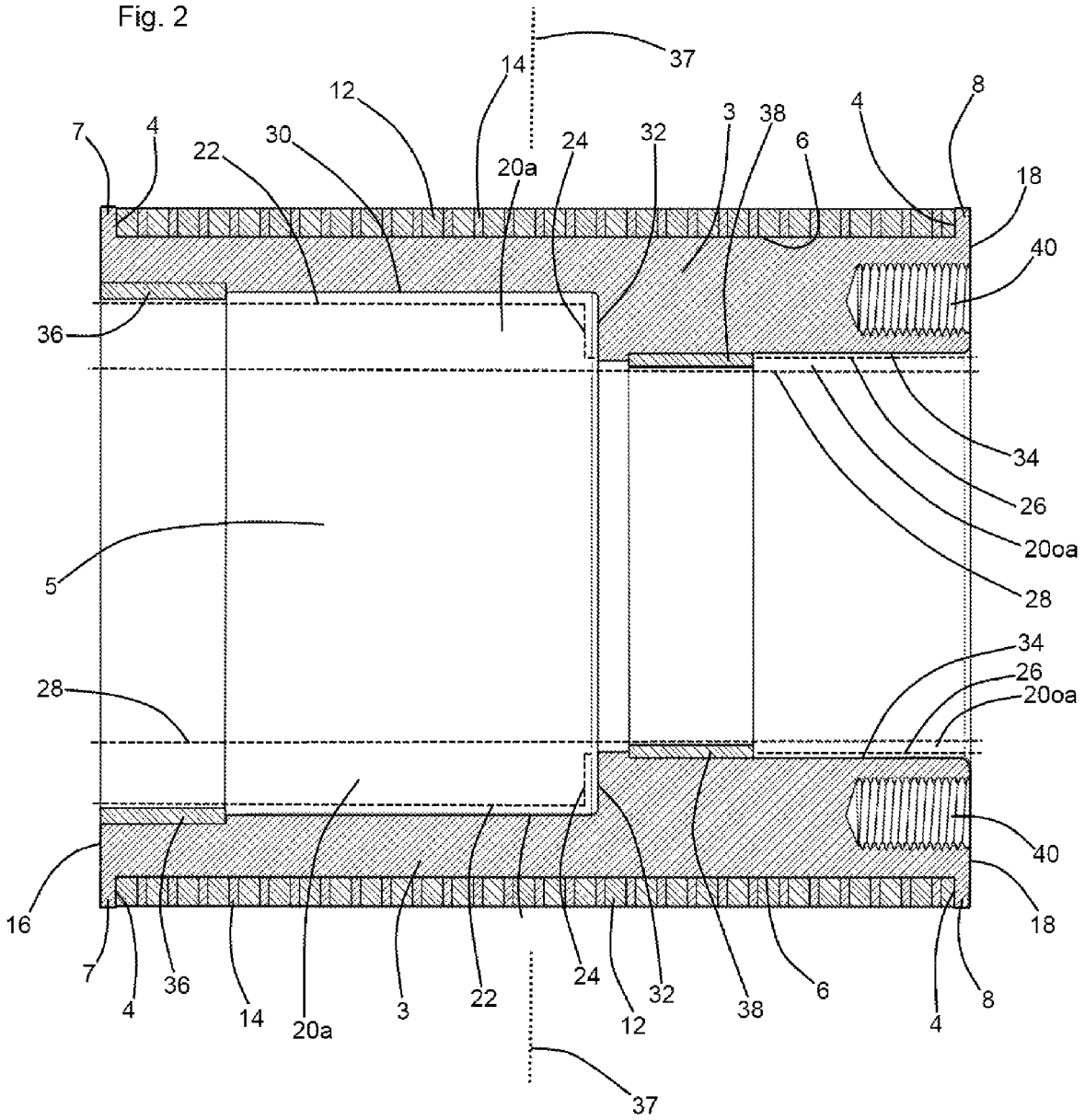
FIG. 2 is a sectional view as indicated in FIG. 1.
Figure 3:
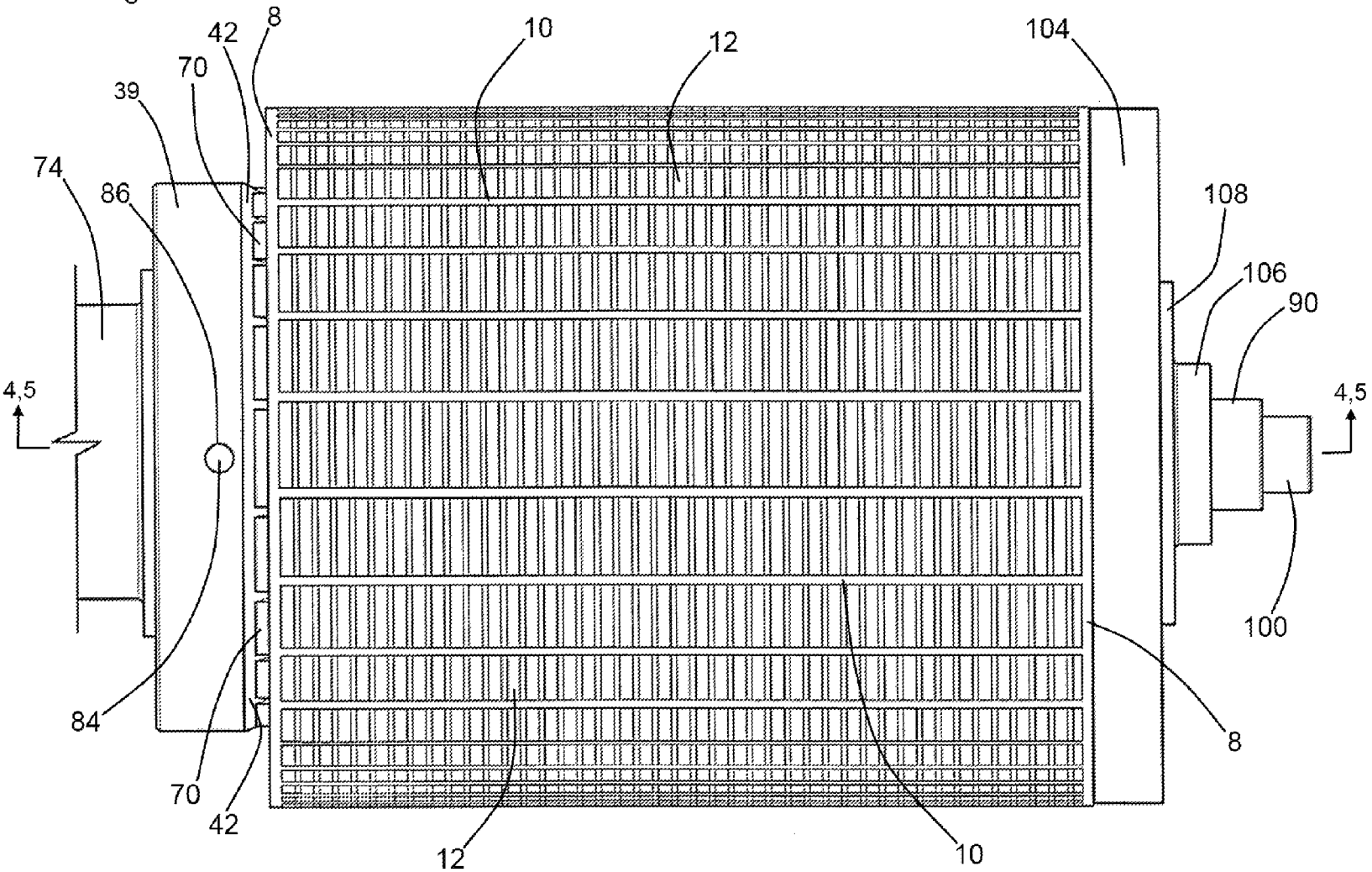
FIG. 3 depicts the assembly of FIG. 1, the view of FIG. 3 further showing axially received mounting axle components.

Referring now to the drawings, and in particular to Drawing FIG. 1, a preferred embodiment of the instant inventive printing assembly includes a cylinder or roll component which is referred to generally by Reference Arrow 1. The cylinder 1 has an outer circumferential surface comprising radially outer aspects of ridges 10 and axial and oppositely axial cylinder surfaces 7 and 8 situated at the cylinder's axial and oppositely axial ends 16 and 18. Referring further simultaneously to FIG. 2, the cylinder ends 7 and 8, and axially extending ridges 10 in combination with outer surfaces 6 of the cylinder's body 3 advantageously form a plurality of magnet and magnetic pole pieces receiving recesses 2,4.

Figure 4:
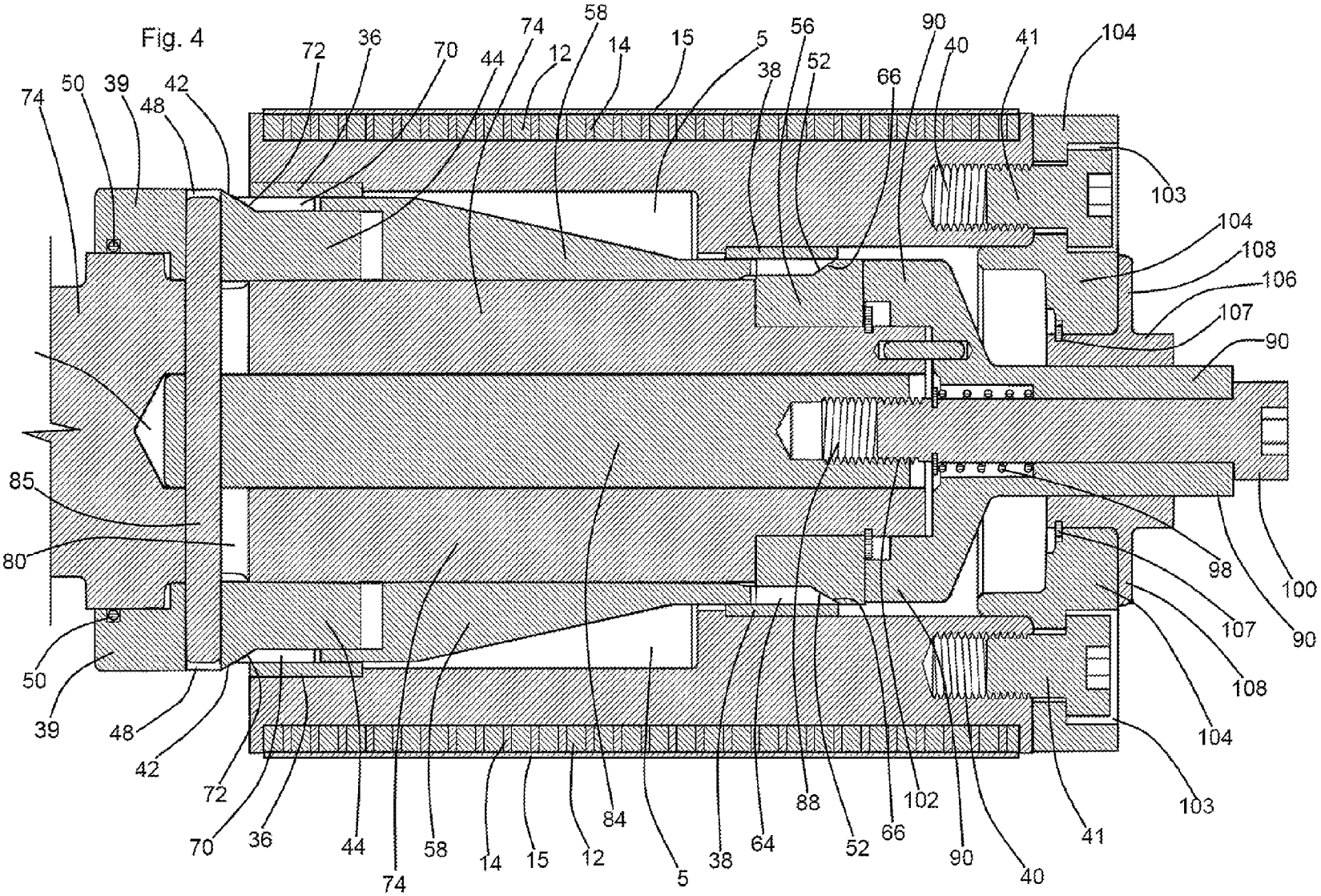
FIG. 4 is a sectional view as indicated in FIG. 3.

Multiplicities of magnets 12, and mild paramagnetic steel pole pieces 14 are preferably fixedly embedded via adhesive bonding within the recesses 2,4, so that the radially outer surfaces of the magnets 12 and pole pieces 14 form with the radially outer surfaces of the ridges 10 a substantially continuous outer circumferential surface for, referring further simultaneously to FIG. 4, secure attachment and mounting of flexible ferro-magnetic printing die 15.

In a preferred embodiment, the poles of the magnets 12 are axially aligned and the magnets 12 are arranged in relation to each other in an " . . . NN, SS, NN, SS, NN, SS . . . " series order. Each magnet 12 of the series preferably abuts a pole piece 14 at each of its poles. Such orientation and arrangement of the magnets 12 in relation to the pole pieces 14 advantageously maximizes attractive magnetic die plate holding strength at the cylinder's outer circumferential surface.

Referring simultaneously to FIGS. 1 and 2, the instant inventive printing assembly preferably further comprises a clamping annulus which is referred to and identified by Reference Numerals 20*a* and 20*oa*, 20*a* representing an axial end of such annulus and 20*oa* representing an oppositely axial end of such annulus. An outer circumferential end or limit of the clamping annulus 20*a*,20*oa* is associated with Reference Numerals 22 and 26, such circumferential end 22,26 preferably being tiered or stepped so that the diameter of the axial end of the clamping annulus 20*a* is markedly greater than the diameter of the oppositely axial end of the clamping annulus 20*oa*. Such diameter differential is reflected at a tiered step or transition 24 between the two annulus portions. In a preferred embodiment, such diameter differential is between 1" and 2".

Referring to FIG. 2, a radially inner periphery or limit of the instant invention's clamping annulus 20*a*,20*oa* is denoted by Reference Numeral 28. The enlarged axial end of the clamping annulus 20*a*,20*oa* advantageously forms and defines a toroidal guide sleeve receiving space which may advantageously assist in insertions into and receipts of a clamp jaw supporting guide sleeve which is discussed further below.

Referring simultaneously to FIGS. 1 and 2, the cylinder 1 preferably has a hollow bore 5 which is formed and defined by the cylinder's tiered inner wall 30,34. Similarly with the clamping annulus 20*a*,20*oa*, the diameter of the axial end of bore 5 defined by inner wall portion 30 is markedly greater than the corresponding oppositely axial diameter defined by inner wall 34, and a preferably 90° annular step or land 32 forms a transition between such inner wall tiers. Axial and oppositely axial compression rings 36 and 38 are preferably closely fitted to and are fixedly mounted upon inner wall tiers 30 and 34. For purpose of balancing of compressive holding of the cylinder 1 as discussed below, the compression rings 36 and 38 are preferably mounted at axial and oppositely axial sides of a cross-sectional mid-line or mid-plane 37. Helically threaded mounting plate attachment sockets 40 are preferably presented at the oppositely axial end 18 of the cylinder 1.

Figure 5:
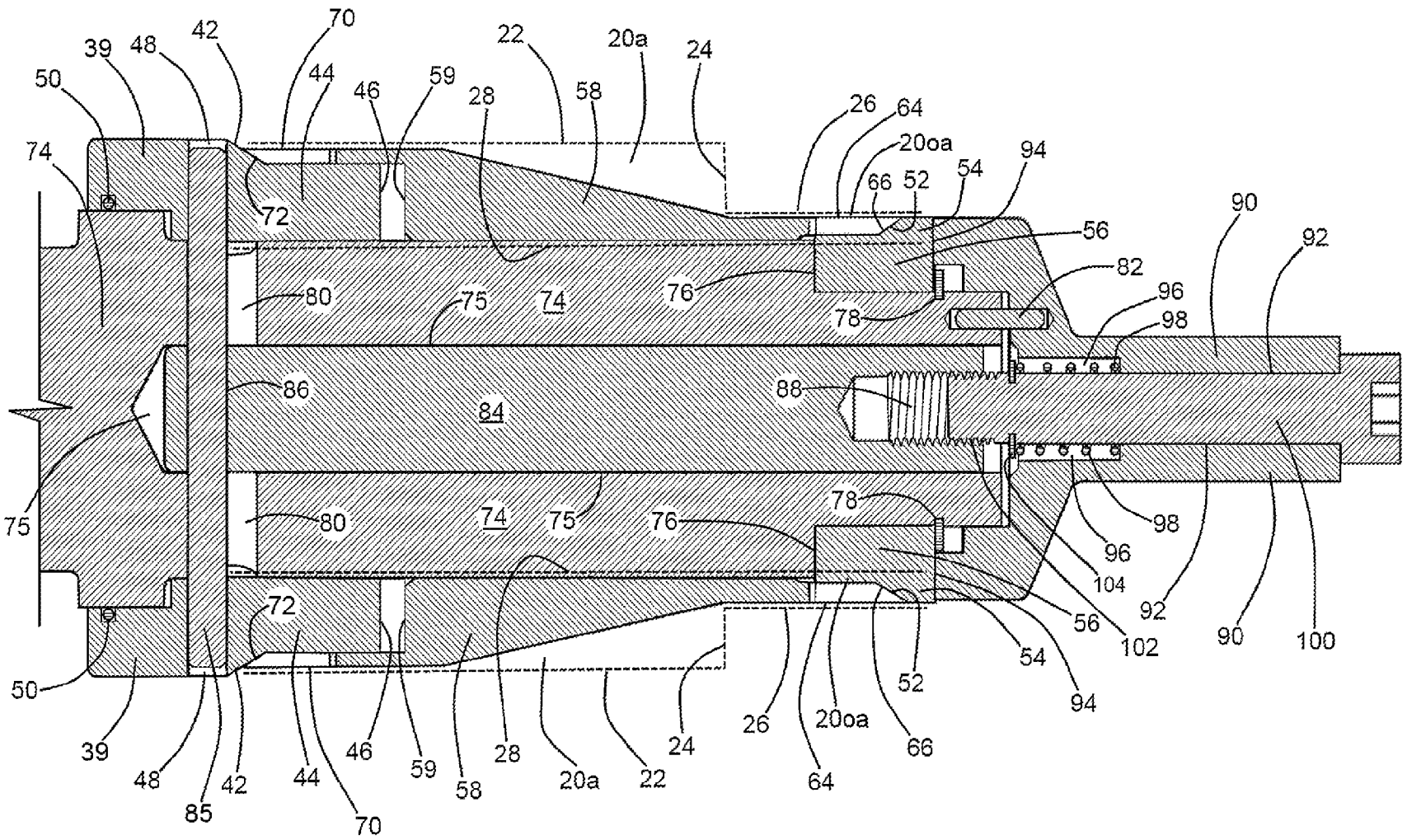
FIG. 5 redepicts the structure shown in the sectional view of FIG. 4, the view of FIG. 5 omitting radially outer cylinder components of the assembly.

Referring simultaneously to FIGS. 1, 2, and 5, it may be seen that the clamping annulus component 20*a*,20*oa*,22,24, 26,28 is represented in both drawings. In FIG. 5 the cylinder components of FIG. 2 are removed and axle components of the instant inventive assembly are presented. Drive axle 74 which extends from a printing machine (not shown within views) may provide cantilevering support for and rotational drive to the cylinder 1. The axle 74 preferably includes or incorporates an oppositely axial clamp jaw ring 56, such ring preferably having a radially enlarged oppositely axial end 54 whose axial face 52 is annularly chamfered or beveled. The inside diameter of the clamp jaw ring 56 is preferably closely fitted to the outside diameter of an inwardly stepped oppositely axial end of axle 74, and the axial end of ring 56 preferably securely abuts axle step or land 76. In a preferred embodiment, clamp jaw ring 56 is securely held in place against land 76 by a retainer clip 78. By providing such retainer clip 78, and by configuring the oppositely axial clamp jaw ring 56 for function as a removable and attachable component of axle 74, the instant invention allows for axial installations of components over the axle 74 without interference with the enlarged jaw portion 54 of ring 56. Further structural components of the instant invention's axle component include a tie travel channel 75 and a "T" bar travel channel 80 whose functions are further discussed below.

Figure 6:
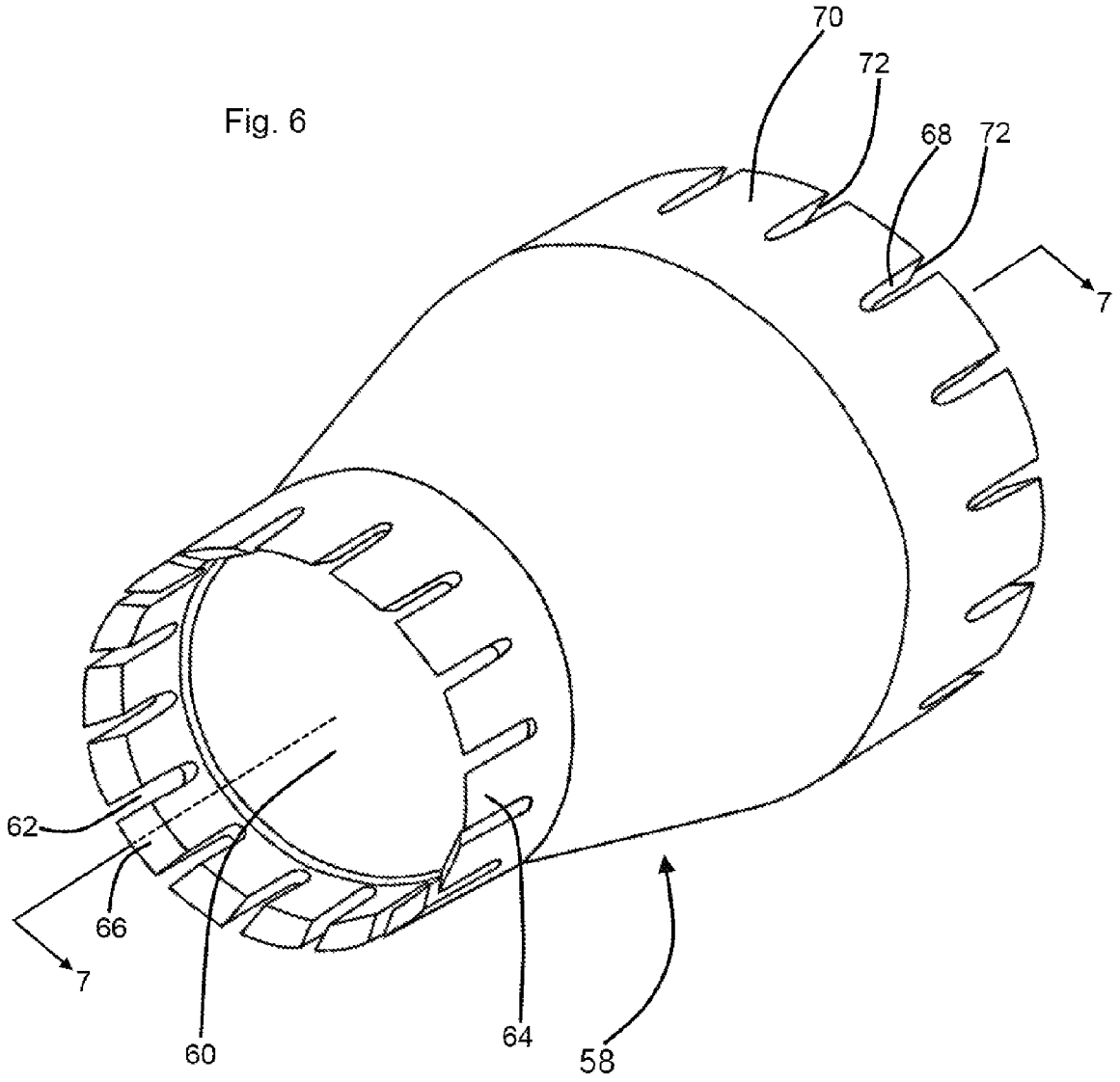
FIG. 6 is perspective view of a tiered clamping sleeve component of the instant inventive assembly.
Figure 7:
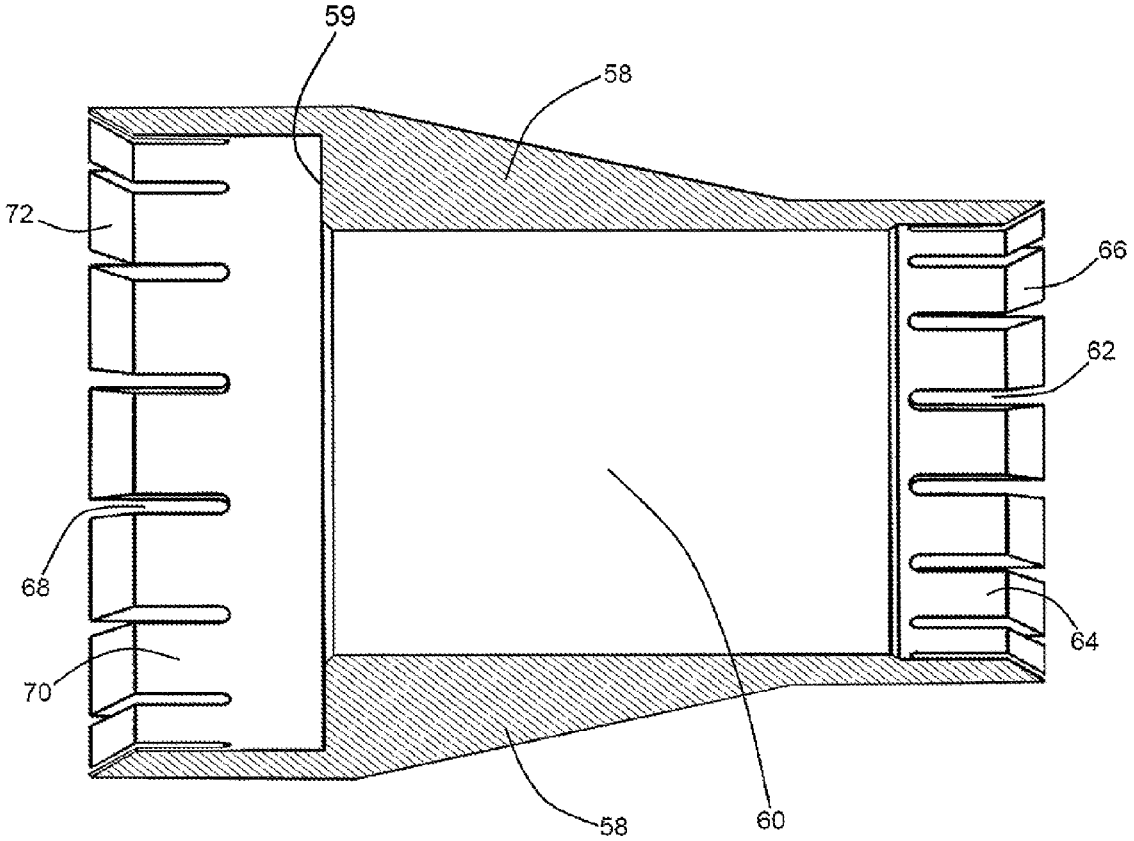
FIG. 7 is a sectional view as indicated in FIG. 6.

Referring simultaneously to FIGS. 5-7, a tiered clamping sleeve component of the instant inventive assembly is referred to generally by Reference Arrow 58. The axial end of the tiered clamping sleeve 58 preferably presents an inwardly and annularly chamfered face 72, and the oppositely axial end of such sleeve preferably correspondingly presents an annular inwardly chamfered face 66. The axial and oppositely axial ends of the tiered clamping sleeve 68 preferably respectively present radially arrayed slots 68 and 62 which divide the chamfered faces 72 and 66 into radially arrayed pluralities of wedge clamping sections 70 and 64. The inside diameter of the bore 60 of sleeve 58 is preferably closely fitted for sliding receipt of axle 74, and the oppositely axial end of the bore 60 preferably presents an outward step or tier 59 for guide sleeve receipt and clearance as discussed below.

Referring further simultaneously to FIGS. 5-7, upon slidable mounting of the tier clamping sleeve 58 over the axle 70, in the manner depicted in FIG. 5, and upon forceful driving of the sleeve 58 in the oppositely axial direction, chamfered faces 52 and 66 advantageously engage each other to radially outwardly deflect wedge sections 64 within the oppositely axial portion 20*oa* of the assembly's clamping annulus. In order to effectively exert such oppositely axially directed driving force against the tiered clamping sleeve 58, an annular and outwardly chamfered jaw face 42 is preferably provided, such face preferably being positioned for similarly angled engagements with chamfered axial face 72 of sleeve 58. As a result of such matching chamfered engagement of faces 42,72, an oppositely axial driving force may be translated to faces 52,56 while wedge sections 70 of sleeve 58 are substantially simultaneously radially outwardly deflected within the clamping annulus's axial end 20*a*.

In order to effectively support and guide the oppositely axial driving action of the axial jaw 42, a ring configured guide sleeve 44 is preferably fixedly attached to or formed wholly with the axial jaw 42, such guide sleeve 44 preferably being closely fitted for sliding receipt over the axle 74 and within the annulus formed by sleeve step 59 and wedge sections 70. The oppositely axial end 46 of the guide sleeve 44 preferably terminates short of any interference with or impingement against sleeve step 59.

Referring further to FIG. 5, means for oppositely axially driving jaw face 42 against the tiered clamping sleeve 58 in the manner described above are preferably provided, such means preferably comprising a jack screw assembly.

Such assembly preferably comprises a bolt 100 having helical threads at its axial end. The bolt 100 is preferably rotatably supported at the oppositely axial end of the axle 74 by means of a bearing ring 90 whose axial end is fitted for receiving and bridging over axle end components, and fitted for abutting engagement of ring face 94 against the oppositely axial face of clamp jaw ring 56. A rotation stopping pin 82 is preferably provided for allowing axial installations and deinstallations of bearing ring 90 over the oppositely axial end of axle 74 while resisting rotation of that ring with respect to the axle 74.

The axial end 96 of the bore 92 which rotatably receives bolt 100 is preferably enlarged for receipt of a coaxially mounted biasing spring 98 which, in operative engagement with clip 104, axially biases the bolt 100 for easing threaded engagements as discussed below.

Referring further to FIG. 5, a tie bar 84 which is closely fitted for sliding axial movement within the channel 75 of axle 74 preferably presents an oppositely axially opening helically threaded socket 88. Upon threaded engagement of the bolt 100 with said socket's threads and upon clockwise and right-handed turning of the bolt 100, tie bar 84 is advantageously pulled in the oppositely axial direction with respect to the axle 74. A "T" bar 85 preferably extends in the radial direction through a radially extending channel 86 within the axial end of the tie bar 84, and upon such oppositely axial drawing of tie bar 84, "T" bar 85 is simultaneously drawn oppositely axially.

Referring further to FIG. 5, the assembly's axial jaw 42 preferably includes an annular rearward extension 39, such extension preferably forming and defining a "T" bar receiving channel 48. Upon engagement of "T" bar 85 with the "T" bar receiving channel 48, the above described oppositely axial drawing force applied to the tie bar 84 further simultaneously drives jaw 42 against the axial end of the tiered clamping sleeve 58 for radially outwardly clamping deflections of, referring further simultaneously to FIG. 7 wedge clamping sections 64 and 70. A dirt and debris sealing "O" ring 50 is preferably interposed between the axle 74 and the axial extension 39 of clamp jaw 42.

Referring simultaneously to FIGS. 1, 2, 4, and 5, the cylinder 1 of FIG. 1 is shown in FIG. 5 as installed over axle 74. The above described radially outward clamping deflections of the wedge sections 70 and 64 of the clamping sleeve 58 within the clamping annulus 20*a*,20*oa* advantageously drives those wedge sections 70 and 64 radially outwardly against the axial and oppositely axial compression rings 36 and 38.

Such radially outward deflections of wedge sections 70 and 64 advantageously securely hold and position the cylinder 1 at a specifically desired location and orientation with respect to axle 74, such positioning provides for secure and accurate alignment of a magnetically attached ferro-magnetic printing plate 15.

Referring simultaneously to FIGS. 1 and 4, a cylinder end cap 104 is preferably fixedly and removably attached to the oppositely axial end of cylinder 1 by means of helically threaded bolts 41 which extend through bolt receiving apertures 103 within end cap 104, and which threadedly engage helically threaded sockets 40. For purposes of close fitting of the end cap 104, and for sealing the assembly against intrusions of dirt and debris, a closely fitted spacer ring 106 having flange 108 and retainer clip 107 is interposed between end cap 104 and bearing member 90.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

The invention hereby claimed is:

1. A printing assembly comprising:

(a) a clamping annulus having axial and oppositely axial ends, the clamping annulus's axial and oppositely axial ends having outside diameters, the axial end's outside diameter having with respect to the oppositely axial end's outside diameter, an excess dimension, the excess dimension defining a guide sleeve receiving space;

(b) a tiered clamping sleeve nestingly received within the clamping annulus, the tiered clamping sleeve having chamfered axial and oppositely axial ends;

(c) axial and oppositely axial jaw faces respectively fitted for sloped engagements with the tiered clamping sleeve's chamfered axial and oppositely axial ends;

(d) axial and oppositely axial jaws respectively operatively connected to the axial and oppositely axial jaw faces, the axial jaw comprising an oppositely axially extending guide sleeve;

(e) an axle extending through the tiered clamping sleeve; and (f) drawing means mounted to the axle, the drawing means being adapted for respectively pressing the axial and oppositely axial jaw faces against the tiered clamping sleeve's chamfered axial and oppositely axial ends, and for radially outwardly wedging said ends toward the clamping annulus's tiered circumferential end.

2. The print assembly of claim 1 further comprising axial and oppositely axial pluralities of expansion notches, said notch pluralities being respectively circumferentially arrayed at the tiered clamping sleeve's axial and oppositely axial ends.

3. The print assembly of claim 2 wherein one of the jaws among the axial and oppositely axial jaws is fixed in relation to the axle, the other jaw moving toward the one jaw upon actuation of the drawing means.

4. The print assembly of claim 3 wherein the axle is axially channeled, wherein the drawing means comprise a tie slidably mounted within the axle's channel, and further comprising linking means interconnecting the tie and said other jaw for, upon movement of the tie toward the one jaw, actuating the other jaw's movement toward the one jaw.

5. The printing assembly of claim 4 wherein the linking means comprise a "T" bar and travel slot combination, the travel slot extending through the axle, and the "T" bar extending through the travel slot and through the tie.

6. The printing assembly of claim 5 wherein the tie and the axle have axial and oppositely axial ends, wherein the "T" bar's extension through the tie is positioned at the tie's axial end, and wherein the drawing means further comprise a jack screw actuator operatively interconnecting the oppositely axial ends of the axle and the tie.

7. The printing assembly of claim 6 further comprising a printing cylinder having a tiered bore wall, the printing cylinder being positioned for, upon the radially outwardly wedging of the tiered clamping sleeve's chamfered axial and oppositely axial ends, impingement of said ends against the tiered bore wall, said impingements fixing the printing cylinder upon the axle.

* * * * *